United States Patent [19]

Arnold

[11] Patent Number: 4,867,491

[45] Date of Patent: Sep. 19, 1989

[54] LOCKING DEVICE FOR DOORS OR WINDOWS INCLUDING MEANS FOR LOCKING THE SQUARE-SECTIONED HANDLE-BAR OF THE HANDLE

[75] Inventor: André Arnold, Reding, France

[73] Assignee: Ferco International, Sarrebourg, France

[21] Appl. No.: 131,429

[22] Filed: Dec. 10, 1987

[30] Foreign Application Priority Data

Dec. 11, 1986 [FR] France ..... 86 17458

[51] Int. Cl.[4] ..... E05C 1/04

[52] U.S. Cl. ..... 292/150; 292/359

[58] Field of Search ..... 292/137, 145, 152, 175, 292/163, 147, 359, 150

[56] References Cited

U.S. PATENT DOCUMENTS

| | | | |
|---|---|---|---|
| 377,815 | 2/1888 | Selleck et al. | 292/359 |
| 396,571 | 1/1889 | Iddings et al. | 292/359 |
| 1,760,394 | 5/1930 | Best et al. | 292/359 |
| 2,851,871 | 9/1958 | Newell | 292/359 X |
| 4,121,863 | 10/1978 | Laureno | 292/150 X |

FOREIGN PATENT DOCUMENTS

| | | | |
|---|---|---|---|
| 1017570 | 1/1966 | United Kingdom | 292/147 |

*Primary Examiner*—Richard E. Moore

*Attorney, Agent, or Firm*—Sandler & Greenblum

[57] ABSTRACT

A locking device for doors, windows or the like includes a fixed element in which a movable element is slidably mounted. The movable element is configured for locking against rotation the square-section spindle or handle-bar to which the handle controlling the opening and closing of the door or window is fitted. Mechanism are provided to immobilize the movable element relative to the fixed element in both the locked position and the unlocked position of the locking device. The movable element includes catches or lugs adapted to engage openings formed in the fixed element. This locking device is adapted to be fastened to the jamb of the movable frame of a door or window, and more particularly between the movable frame and the square-section spindle of handle-bar.

15 Claims, 2 Drawing Sheets

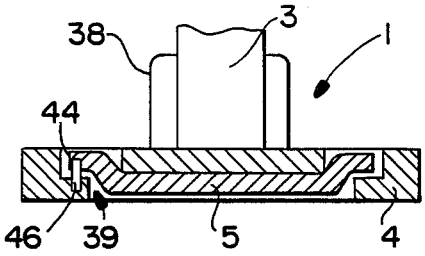
Fig. 5
Fig. 4
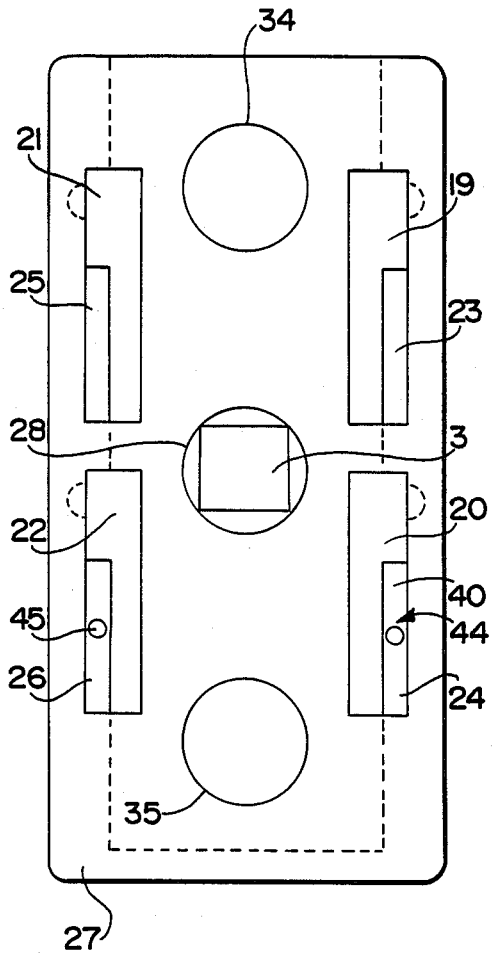
Fig. 6
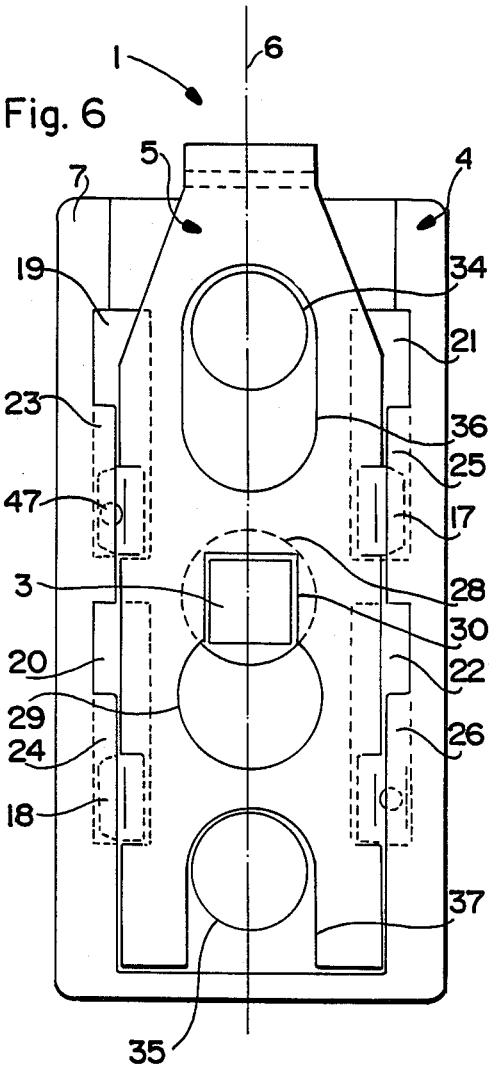

LOCKING DEVICE FOR DOORS OR WINDOWS INCLUDING MEANS FOR LOCKING THE SQUARE-SECTIONED HANDLE-BAR OF THE HANDLE

BACKGROUND OF THE INVENTION

1. Field of the Invention

This invention relates to a locking device for doors, windows or the like, which is applicable more particularly to fittings for doors, windows or the like.

2. The Prior Art

As a rule, a house door is locked by means of a casement lock either mortised in the edge of the jamb of the movable frame of the door, or fastened to the main surface thereof. This casement lock comprises a mechanism transmitting the movement impressed to the handle to locking means such as a half-turn bolt or a plurality of bolting members somewhat spaced from each other and connected to the mechanism by means of control rods. These casement locks comprise in general a cylinder lock actuated by means of a key and driving a fixed bolt. The various locking means comprising the bolts, the half-turn bolt and the dead bolt are actuated by a particularly complicated mechanism which increases considerably the cost of the casement lock.

On the other hand, casement locks are also known which comprise a half-turn bolt and/or a plurality of bolts or locking members somewhat spaced from the casement bolt case and actuated by control rods. All the bolt members are retracted only by means of a handle, not by means of a handle plus the key of a cylinder lock, as in the case of a casement lock.

In frequent cases the above-mentioned casement locks or casement bolts are used for closing and locking doors and may also be used for closing windows.

However, the two types of locks mentioned hereinabove are attended by various inconveniences.

Casement locks, as already mentioned, are relatively complicated and therefore expensive. The complexity of their component elements is also likely to reduce the useful life of the locking means.

On the other hand, in the case of casement bolts, it is possible to open the door, window closure or the like from outside by actuating the bolts thereof. These bolts are rigidly connected to rods and can easily be released from the keepers or striker plate fastened or formed on the fixed jamb of the frame by simply hooking the bolts and pulling them down to their release position. If the casement bolt comprises only a single half-turn bolt, a simple tool of any kind is sufficient for retracting and recessing the half-turn bolt, in case the latter is adapted to rotate about an axis, and it is also possible to retract the half-turn bolt by rotating it through a half-turn in the opposite direction.

A backward movement of the locking member is attained almost automatically by the rotation of the control handle. It is therefore advisable to lock this handle against rotation and thus present any actuation of the locking members.

For this purpose, a handle has already been proposed which incorporates a locking device. As a rule, this handle is relatively bulky in cross section since all the component elements of the locking device must be enclosed therein. For the sake of convenience, this handle has the appearance of a round-sectioned knob. However, this arrangement for locking a door or window is applicable only to a well-defined handle construction and therefore restricts the choice of a handle from the dual point of view of shape and type. On the other hand, the relatively large cross-sectional area of the handle may also prove detrimental, notably in case the frame of the door or window has a relatively narrow jamb.

It is the essential object of the present invention to avoid the above-described inconveniences.

SUMMARY OF THE INVENTION

The present invention is directed to provide locking device for doors, windows or the like, which comprises means for locking the square-sectioned handle-bar or spindle, said locking means being sandwiched between the inner face of the movable frame of the door or window and the handle-bar or spindle of the control handle.

The essential advantageous features characterizing the present invention lie in the fact that the various existing handles can be provided with a locking device adapted positively to prevent any untimely or undesired rotation of the handle and, consequently, the rotation of the control handle-bar. Another advantageous feature of the present invention is its extremely simple and economical construction.

Other features and advantages of the invention will appear as the following description proceeds with reference to the accompanying drawings.

THE DRAWINGS

Figure 1:
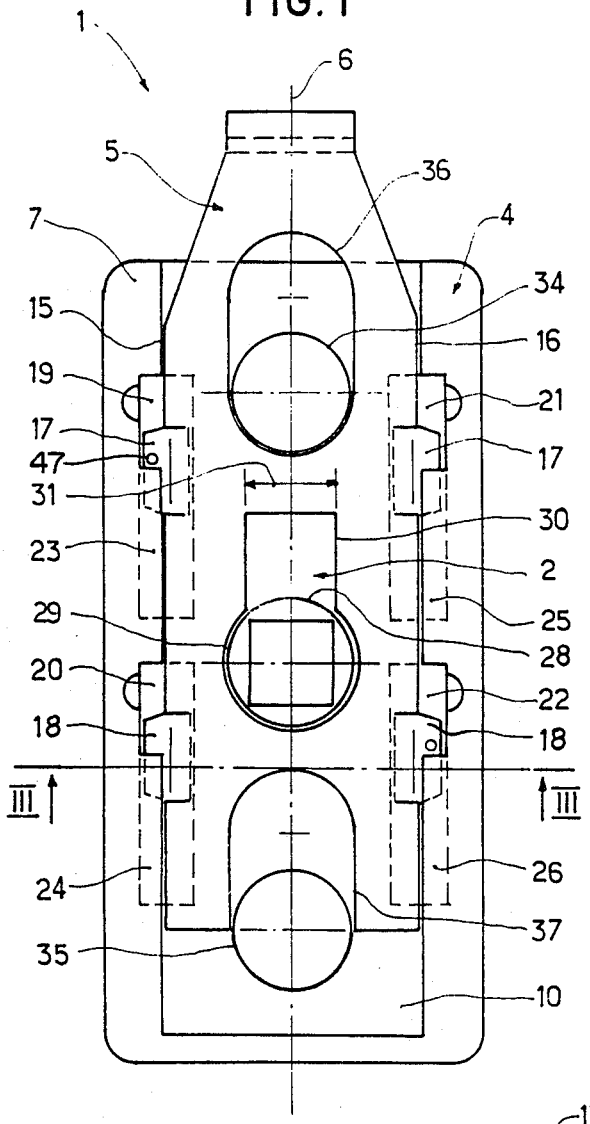
FIG. 1 is an elevational view of the locking device according to the present invention.
Figure 2:
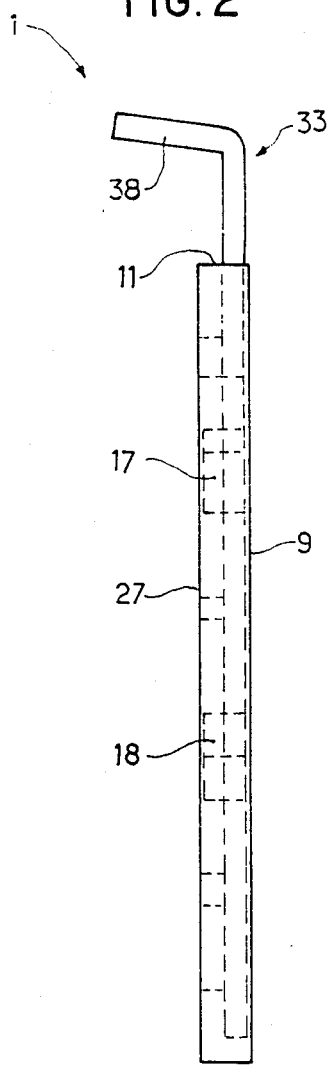
FIG. 2 is a side view of the locking device of FIG. 1.
Figure 3:
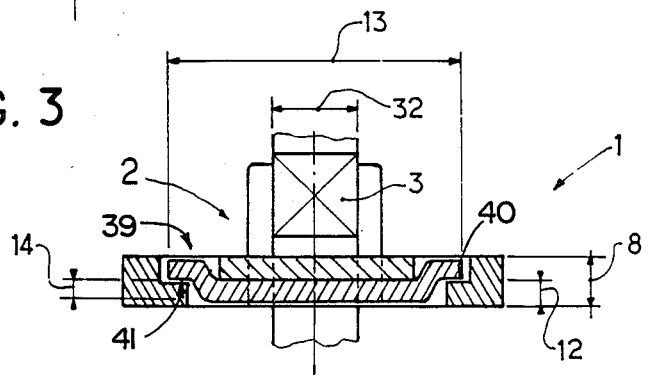

FIG. 3 is a plane and sectional view of the same device, the section being taken along the line III—III of FIG. 1, FIG. 4 is a rear elevation view of an element of the locking device of the present invention to be fixed to the jamb of a movable door in window frame, FIG. 5 is a plan view in cross-section of the locking device of the present invention, illustrating one type of means for immobilizing the movable element relative to the fixed element, and FIG. 6 is an elevation view of the locking device according to the present invention in its locking position.

DESCRIPTION OF THE PREFERRED EMBODIMENTS

The locking device 1 for doors, windows or the like comprises, according to the present invention, means 2 for locking the square-sectioned control handle-bar 3 of a control knob or handle for a door or window.

According to a preferred form of embodiment of the present invention, the locking device 1 comprises two component elements, namely a fixed element 4 and a movable element 5. The movable element 5 is slidably mounted in the fixed element 4 and comprises means 2 for locking the handle-bar 3 of the control knob or handle. It will be seen that this locking device 1 is perfectly symmetrical with respect to the median vertical axis 6.

The fixed element 4 consists of a metal or plastic plate 7, preferably of rectangular configuration, having a relatively reduced thickness 8. This plate 7 has a recess 10 formed in its front face 9 which extends longitudinally and opens on the upper edge 11 of plate 7. The depth 12 of recess 10 is about one-half the thickness 8 of plate 7.

The movable element 5 is adapted to fit flush in recess 10 and consists of a preferably metallic plate of a shape consistent with that of said recess 10. For this purpose, the movable element 5 has a width 13 slightly less than that of said recess 10. On the other hand, the thickness 14 of the plate constituting the movable element 5 is slightly less than the depth 12 of recess 10. Thus, the movable element 5 can slide freely in the recess 10 of plate 7.

After to the insertion of the movable element 5 into the fixed element 4, the locking device 1 is engaged on the control handle-bar 3 to which the knob controlling the door or window is to be fitted. For this purpose, the plate 7 and the movable element 5 are provided with a central opening 28, 29 engageable with the control handle-bar 3.

According to a specific feature characterizing the present invention, the movable element 5 is also provided with a rectangular notch 30 merging into the central opening 29 and extending in the longitudinal direction of the locking device 1. The width 31 of this notch 30 is slightly greater than the length of one side 32 of the square-sectioned handle-bar 3 and consequently smaller than the diagonal of the square-sectioned handle-bar 3.

Thus, when the movable element 5 is in its upper position (as shown in FIG. 1) the square-sectioned handle-bar 3 engages the central opening 29 of the movable element 3, thus enabling the free rotation of said handle-bar 3. On the other hand, when a pressure is exerted on the top end 33 of the movable element 5, the two pairs of catches or lugs 17, 18 slide in grooves 23, 24, 25, 26 and the notch 30 engages the square-sectioned handle-bar 3, thus positively preventing the rotation of the handle-bar 3 and consequently of the handle fitted thereon.

This mutual engagement between the notch 30 and the square-sectioned handle-bar 3 during the sliding movement of the movable element 5 in the fixed element 4 constitutes an efficient means 2 for locking the device 1.

The plate 2 also comprises another pair of openings 34, 35 disposed on either side of the central opening 28 and permitting the passage of fastening members such as screws. Similarly, the movable element 5 has an elongated notch 36 and a notch 37 formed therein for receiving said fastening members. These fastening members co-operate with the lower edge of elongated opening 36 and with the upper edge of notch 37 to limit the permissible stroke of the movable element 5 in the fixed element 4. The length of this stroke corresponds to the length of notch 30, so that the movable element 5 can slide between a locking position and a release position.

According to another feature characterizing this invention, the movable element 5 comprises at its upper end 33 a control lug 38 facilitating the actuation of the locking device 1.

The chief advantage of the locking device 1 according to the present invention is that the user can lock at will the handle-bar 3 of a handle controlling the opening and closing of a door, window or the like. For this purpose, this locking device is advantageously provided with means 39 for locking against movement the movable element 5 in both locking or release positions with respect to the fixed element 4. In fact, it is necessary to avoid any undesired or untimely locking or release of the handle-bar without the user's intervention. This might either prevent the user from entering or coming out from a locked room, or, on the contrary, facilitate the ingress of a swindler into a house.

According to a preferred form of embodiment, said means 39 consist on the one hand of the catches or lugs 17, 18 disposed respectively along the longitudinal edges 15, 16 of movable element 5 and adapted to engage recesses or slots 19, 20, 21, 22 formed in plate 7. These catches 17, 18 have a specific configuration and are slightly off-set with respect to the plane of the movable element 5, so that they can engage the grooves 23, 24, 25, 26 formed in the back surface 27 of plate 7, said grooves 23, 24, 25, 26 being in prolongation of the recesses 19, 20, 21, 22, respectively.

On the other hand, the means 39 for holding the movable element 5 against movement with respect to the fixed element 4 in the locked and release positions are completed by resilient means 44 inserted in grooves 23, 24, 25, 26 of plate 7 co-operating with the catches 17, 18. More particularly, the function of these resilient means consists in increasing appreciably the frictional engagement between the catches 17, 18 and the registering faces of grooves 23, 24, 25, 26 when the movable element 5 is moved to its endmost positions in which the handle-bar 3 is locked or released.

Thus, according to a first form of embodiment, said resilient means are made of plastic, metal or other suitable material represented as 45 and project from the bottom 40 of grooves 23, 24, 25, 26. According to a modified form of embodiment, spring-loaded balls 46 are disposed in the bottom 40 of said grooves at predetermined locations. These balls are adapted to penetrate moderately into matching hemispheric recesses 47 formed in the front face 41 of catches 17, 18 when the movable element 5 is in the handle-bar locking or release position.

By virtue of the above-described specific features, the locking device 1 can be actuated according to the user's desires, without any aleatory risk. Besides, the fitting on of this device is facilitated due to the possibility of pre-assembling the fixed element 4 and movable element 5.

The locking device 1 according to the instant invention is adaptable to all kinds of control handles for doors or windows, and can easily be concealed behind the rosette usually associated with the control handle.

In this respect and according to a modified form of embodiment of the present invention, the locking device 1 and the rosette are fastened to the movable frame of the door or window by using conventional fastening means.

What is claimed as new is:

1. A device for locking a spindle of a closure handle against rotation comprising:

(a) a fixed element attachable to said closure to be fixed against movement relative thereto;

(b) a movable element movably connected to said fixed element and dimensioned and configured relative to said spindle such that said movable element is movable between (1) a locked position, relative to said fixed element, in which said spindle is locked against rotation and (2) an unlocked position, relative to said fixed element, in which said spindle is free to rotate; and (c) means for holding said movable element in both said locked position and said unlocked position comprising (1) at least one lug projecting from said movable element; (2) at least one groove located in said fixed element for slidably receiving and retaining said at least one lug of said movable element; and (3) means operably associated with said at least one lug and said fixed element, within said at least one groove, for increasing frictional engagement between said at least one lug and said fixed element, within said at least one groove.

2. The device of claim 1, wherein said means for increasing frictional engagement comprises resilient means.

3. The device of claim 2, wherein said resilient means comprises at least one spring-loaded ball.

4. The device of claim 3, further comprising at least one recess located in said movable member, wherein said at least one spring-loaded ball projects from said at least one groove and is receivable in said at least one recess.

5. The device of claim 4, further comprising at least two springloaded balls projecting from each of said at least one groove such that one of said at least two spring-loaded balls is received in a respective one of said at least one recess in said locked position of said movable element and such that another of said at least two spring-loaded balls is received in said respective one of said at least one recess in said unlocked position of said movable element.

6. The device of claim 1, wherein said fixed element has a predetermined thickness and a recess located within said thickness and within which said movable element is confined for movement.

7. The device of claim 6, wherein said movable element has a length and a width, and wherein each of said at least one lug extends widthwise and is offset thickness-wise, and wherein each of said at least one groove is in communication with said recess.

8. The device of claim 7, wherein each of said at least one groove is in communication with a respective further recess having a thickness and width slightly greater than a respective one of said at least one lug such that said fixed element can receive said movable element thickness-wise for assembling said device.

9. The device of claim 1, wherein said at least one lug comprises at least one lug projecting from each side of said movable element.

10. The device of claim 6, wherein said fixed element further comprises two ends defining a length, two sides defining a width, wherein said recess is closed at one of said ends and is open at the other of said ends, and wherein said movable element comprises a control lug that extends beyond said open end.

11. A device for locking a spindle of a closure handle against rotation comprising:

(a) a fixed element attachable to said closure to be fixed against movement thereto, said fixed element having a predetermined length, width, and thickness;

(b) a movable element movably connected to said fixed element and dimensioned and configured relative to said spindle such that said movable element is movable between (1) a locked position, relative to said fixed element, in which said spindle is locked against rotation and (2) an unlocked position, relative to said fixed element, in which said spindle is free to rotate, said movable element having a predetermined length, width and thickness; and (c) means for guiding said movable element relative to said fixed element comprising (1) a recess located within said thickness of said fixed element within which said movable element is confined for movement, wherein said recess has a depth slightly greater than the thickness of said movable element; (2) at least one lug projecting width-wise from said movable element and offset thickness-wise; (3) at least one groove located in said fixed element for slidably receiving and retaining said at least one lug of said movable element; and (4) at least one slot in communication with each of said at least one groove, said at least one slot opening thicknesswise in said fixed element for receiving a respective one of said at least one lug of said movable plate.

12. The device of claim 11, wherein each of said at least one groove has a bottom surface, and wherein a respective one of said lugs overlaps said bottom surface thickness-wise and engages said bottom surface as said movable member moves between said locked position and said unlocked position.

13. The device of claim 12, further comprising means located between said bottom surface of each of said grooves and said respective one of said at least one lug for increasing the frictional engagement therebetween.

14. The device of claim 13, wherein said means for increasing said frictional engagement comprises resilient means.

15. The device of claim 14, wherein said resilient means comprises spring-loaded balls.

* * * * *